United States Patent [19]

Ruckdeschel et al.

[11] 4,098,228

[45] Jul. 4, 1978

[54] HIGH SPEED MAGNETIC BRUSH DEVELOPMENT SYSTEM

[75] Inventors: Frederick R. Ruckdeschel, Webster; Oscar G. Hauser; Charles A. Whited, both of Rochester; Robert E. Gary, Sodus, all of N.Y.

[73] Assignee: Xerox Corporation, Stamford, Conn.

[21] Appl. No.: 743,816

[22] Filed: Nov. 22, 1976

[51] Int. Cl.[2] ..... G03G 15/09

[52] U.S. Cl. ..... 118/658; 427/18

[58] Field of Search ..... 118/658, 657; 427/18; 19/156.3, 145.7; 66/9 B; 355/3 DD

[56] References Cited

U.S. PATENT DOCUMENTS

| | | | |
|---|---|---|---|
| 1,395,877 | 11/1921 | Tillotson | 19/145.7 X |
| 1,584,557 | 5/1926 | Koch | 118/310 |
| 3,126,584 | 3/1964 | Pearson | 19/156.3 X |
| 3,133,834 | 5/1964 | Sowiak | 118/657 |
| 3,402,698 | 9/1968 | Kojima et al. | 118/658 |
| 3,501,812 | 3/1970 | Schmidt | 19/145.7 |
| 3,703,395 | 11/1972 | Drexler et al. | 427/18 |
| 3,739,749 | 6/1973 | Kangas et al. | 118/658 |

FOREIGN PATENT DOCUMENTS

| | | | |
|---|---|---|---|
| 4,017,228 | 8/1965 | Japan | 118/657 |

OTHER PUBLICATIONS

Willis et al., *Cotton Carding*, Washington, D.C., The Textile Foundation, 1936, Chapter 6, p. 81.

*Primary Examiner*—Mervin Stein
*Assistant Examiner*—Andrew M. Falik
*Attorney, Agent, or Firm*—J. J. Ralabate; C. A. Green; H. Fleischer

[57] ABSTRACT

An apparatus in which at least a pair of developer rollers deposit toner particles on an electrostatic latent image recorded on a photoconductive member to render it visible. One of the rollers rotates at a first tangential velocity being spaced a first distance from the photoconductive member. The other roller rotates at a second tangential velocity being spaced a second distance from the photoconductive member. The second tangential velocity is greater than the first tangential velocity with the second distance being less than the first distance.

13 Claims, 2 Drawing Figures

HIGH SPEED MAGNETIC BRUSH DEVELOPMENT SYSTEM

The foregoing abstract is neither intended to define the invention disclosed in the specification, nor is it intended to be limiting as to the scope of the invention in any way.

BACKGROUND OF THE INVENTION

This invention relates to an electrostatographic printing machine, and more particularly concerns an improved development system for use therein.

In the process of electrostatograhic printing, a latent image of an original document is formed and reproduced in viewable form on a copy sheet. The field of electrostatography includes electrophotography and electrography. In electrophotography, a photosensitive medium is employed to form, with the aid of electromagnetic radiation, an electrostatic latent image. Electrography utilizes an insulating medium to form, without the aid of electromagnetic radiation, a latent image. In both of the foregoing processes, the latent image is rendered visible by the process of development, i.e., depositing particles thereon. Frequently, the particles are then transferred from the latent image to a copy sheet, or, in some processes, the sheet having the latent image recorded thereon may serve also as a copy sheet. In either case, the resultant powder image deposited on the copy sheet is permanently affixed thereto by the process of applying heat an/or pressure. Hereinafter, an electrophotographic printing machine will be described as the illustrative embodiment of a printing machine incorporating the features of the present invention therein.

An electrophotographic printing machine employs a photoconductive member which is charged to sensitize the surface thereof. The charged photoconductive member is exposed to a light image of an original document being reproduced. Exposure of the charged photoconductive surface discharges the charge selectively in the irradiated areas, in accordance with the light intensity. This creates an electrostatic latent image on the photoconductive surface corresponding to the informational areas contained within the original document being reproduced. After the electrostatic latent image is recorded on the photoconductive surface, the latent image is eveloped by bringing a developer mix into contact therewith. Generally, a developer mix comprises dyed or colored heat-settable plastic powders, known in the art as toner particles, which are attracted triboelectrically to coarser carrier granules, such as ferromagnetic granules. The toner particles and carrier granules are selected such that the toner particles have the appropriate charge relative to the electrostatic latent image recorded on the photoconductive surface. In this way, when the developer mix is brought into contact with the latent image recorded on the photoconductive surface, the greater attractive force thereof causes the toner particles to be attracted from the carrier granules to the latent image. This general approach was originally disclosed by Carlson in U.S. Pat. No. 2,297,691 and has been further amplified and described by many related patents in the art.

In electrophotographic printing, the most commonly employed development systems are cascade systems and magnetic brush systems. In a cascade system, a conveyer is employed to move the developer mix in an upwardly direction, and then to release it over the electrostatic image. In this way, the developer mix cascades downwardly over the latent image. The toner particles are attracted from the carrier granules rendering the latent image visible. A cascade development apparatus may be speed limited in that gravity is employed to cause the developer mix to descend over the latent image. Contrawise, magnetic brush development systems are not necessarily speed limited. A magnetic brush development system generally employs carrier granules which are ferromagnetic in nature. These carrier granules are held to a developer roll by magnetic attraction. The carrier granules have the toner particles adhering thereto triboelectrically. The carrier granules and toner particles extend in an outwardly direction from the surface of the developer roll forming bristles which simulate a brush. This brush of carrier granules and toner particles is brought into contact with the latent image which attracts the toner particles thereto from the carrier granules. Many electrophotograhic printing machines employ this type of magnetic brush development system. However, when the process speed is increased, the developer mix experiences increased inertial forces as they travel around the curved path which brings them into the development zone. This may cause the carrier granules to impact the photoconductive surface with excessive force. Moreover, the centrifugal force exceeds the centripetal force provided by the magnetic force attracting the developer mix thereto. The excessive force with which the developer mix strikes the photoconductive surface can produce high background densities and increased impactation of the toner particles on the carrier granules. Furthermore, if the centrifugal force becomes too excessive, the carrier granules escape the restraining magnetic force field and the developer mix can be thrown or dumped from the magnetic brush developer roll. Problems of this type may be overcome by reducing the roller speed. However, the desired developer mix flow rate cannot then be attained and the copy density becomes too low.

Hereinbefore, various techniques have been devised to overcome the foregoing problems. These approaches primarily involve varying the spacing and speed of the developer rollers. Exemplary patents disclosing the foregoing are U.S. Pat. No. 3,543,720 issued to Drexler et al. in 1970, U.S. Pat. No. 3,703,395 issued to Drexler et al. in 1972, and U.S. Pat. No. 3,133,834 issued to Sowiak in 1964. The Sowiak patent discloses a photoconductive web entrained about a guide drum. A magnetic brush developer roll serves to feed toner particles to the latent image recorded on the photoreceptor. A mixing drum agitates and mixes the developer mix. The mixing drum is spaced a greater distance from the photoreceptor than the feed brush. The speed of rotation of the feed brush and that of the mixing drum are different from one another. The Drexler patents disclose two magnetic brushes positioned adjacent to a photoconductive web. The brushes are rotated so that they move in a direction opposed to the direction of movement of the web at the points of contact therewith. The feed brush is rotated at a faster rate than the discharge brush. Moreover, the feed brush is space further from the web than the discharge brush.

It is evident, as exemplified by the foregoing patents, that many approaches have been devised to solve the problems encountered in developing an electrostatic latent image in a high speed electrophotographic printing machine. However, many of the problems associated with high speed development have not been overcome.

Accordingly, it is a primary object of the present invention to improve the development system employed in an electrophotographic printing machine so as to produce high quality copies at high speeds.

SUMMARY OF THE INVENTION

Briefly state, and in accordance with the present invention, there is provided an apparatus for depositing particles on a member.

Pursuant to the features of the present invention, the apparatus includes first means, moving at a first velocity and being spaced a first distance from the member. Second means move at a second velocity while being spaced a second distance from the member. The first velocity is less than the second velocity with the distance being greater than the second distance. Both the first and second means are arranged to deposit particles on the member.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
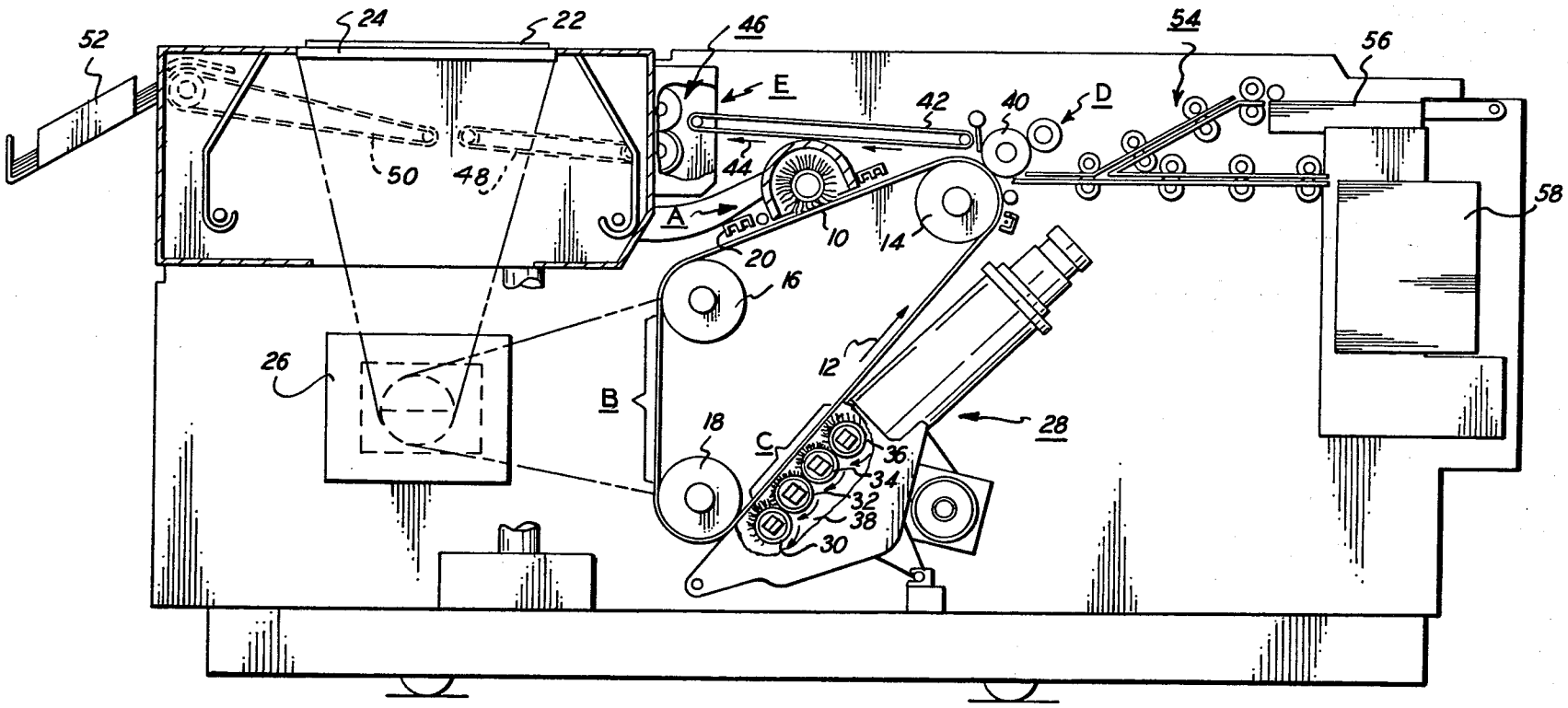
FIG. 1 is a schematic elevational view depicting an electrophotographic printing machine embodying the features of the present invention therein.

For a general understanding of the illustrative electrophotographic printing machine incorporating the features of the present invention therein, reference is had to the drawings. In the drawings, like reference numerals have been used throughout to designate identical elements. FIG. 1 schematically illustrates the various components of an electrophotographic printing machine incorporating the development system of the present invention therein. Although the development system is particularly well adapted for use in an electrophotographic printing machine, it will become evident from the following discussion that it is equally well suited for use in a wide variety of electrostatographic printing machines and is not necessarily limited in its applications to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10. Preferably, belt 10 is made from a photoconductive surface, e.g., a selenium alloy desposited on a conductive substrate. As shown in FIG. 1, belt 10 moves in the direction of arrow 12 to advance sequentially through the various processing stations disposed about the path of movement thereof. Rollers 14, 16 and 18 support belt 10. A drive mechanism, i.e., a suitable motor, is coupled to roller 14 and advances belt 10 in the direction of arrow 12.

Initially, a portion of belt 10 passes through charging station A. At charging station A, a corona generating device indicated generally by the reference numeral 20, charges the photoconductive surface of belt 10 to a relatively high, substantially uniform potential. A suitable corona generating device is described in U.S. Pat. No. 2,836,725 issued to Vyverberg in 1958.

Next, the charged portion of photoconductive belt 10 advances through exposure station B. At exposure station B, an original document 22 is placed face down upon a transparent platen 24. Exposure system 26 includes a lamp for flashing light rays upon original document 22. The light rays reflected from original document 22 pass through the optics of exposure system 26 forming a light image containing the informational areas of the original document therein. The optics, e.g., a suitable lens and mirrors, of exposure system 26 project the light image onto the charged portion of belt 10. In this manner, the charged photoconductive surface of belt 10 is discharged selectively by the light image of the original document. This records an electrostatic latent image on the photoconductive surface of belt 10 which corresponds to the informational areas contained within original document 22.

Thereafter, belt 10 advances the electrostatic latent image recorded thereon to development station C. At development station C, developer unit 28 includes a plurality of magnetic brush developer rollers 30, 32, 34 and 36 disposed in housing 38. These developer rollers advance the developer mix into contact with the electrostatic latent image recorded on the photoconductive surface of belt 10. The developer mix comprises carrier granules having toner particles adhering triboelectrically thereto. Preferably, the carrier granules are formed from a ferromagnetic material while the toner particles are made from a heat settable plastic. In a magnetic brush development system of this type, a chain-like array of developer mix extends in an outwardly direction from each developer roller to contact the electrostatic latent image recorded on the photoconductive surface of belt 10. The latent image attracts the toner particles from the carrier granules forming a toner powder image on belt 10 in image configuration. The detailed structure of developer unit 28 will be discussed hereinafter with reference to FIG. 2.

Next, the toner powder images are transported by belt 10 to transfer station D. Transfer station D is located at a point of tangency on belt 10 as it moves around roller 14. A transfer roller 40 is disposed at transfer station D with the copy sheet being interposed between transfer roll 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Fixing station E includes a fuser assembly, indicated generally by the reference numeral 46. Fuser assembly 46 comprises a heated fuser roll and a back-up roll. The copy sheet having the toner powder image thereon passes between the fuser roll and back-up roll with the toner powder image contacting the fuser roll. In this manner, the toner powder image is permanently affixed to the copy sheet. After fusing, conveyors 48 and 50 advance the copy sheet to catch tray 52.

Turning now to the sheet feeding apparatus, sheet transport 54 advances, in seriatum, successive copy sheets from stack 56, or, in lieu thereof, stack 58. The machine programming enables the operator to select the desired stack from which the copy sheet will be advanced. Thus, the selected copy sheet is advanced to transfer station D where the toner powder image adhering to the photoconductive surface of belt 10 is transferred thereto.

It is believed that the foregoing description is sufficient for purposes of the present application to illustrate the general operation of an electrophotographic printing machine incorporating the features of the present invention therein. Referring now to the specific subject matter of the present invention, FIG. 2 depicts the development apparatus, in detail, employed in the FIG. 1 printing machine.

Figure 2:
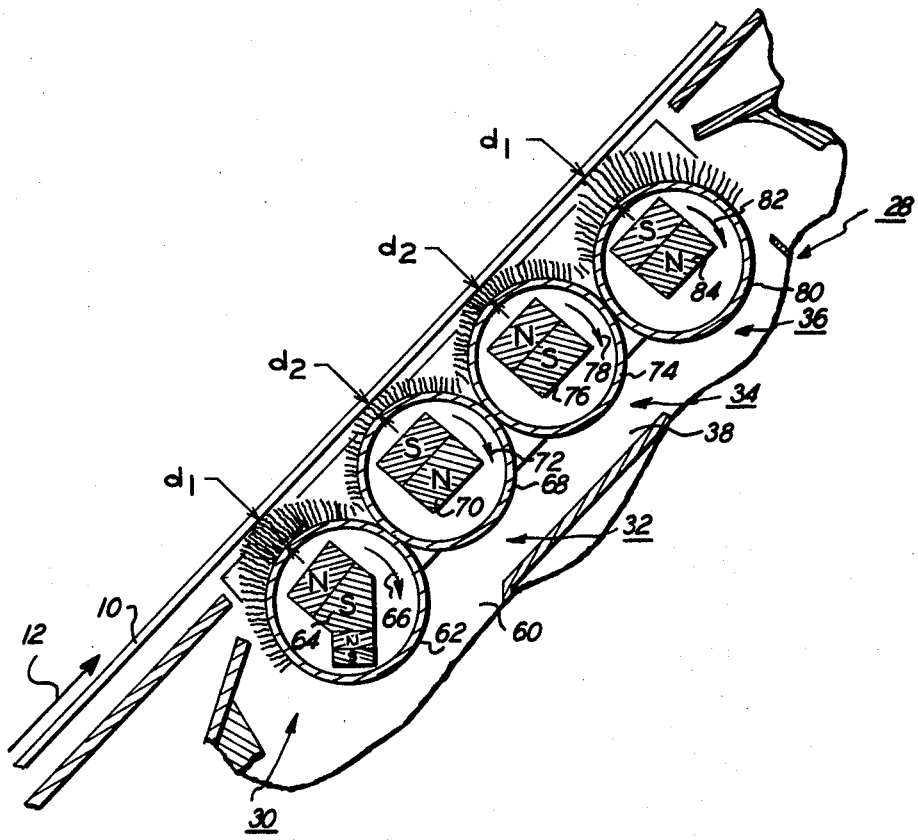
FIG. 2 is an enlarged sectional elevational view showing the development system used in the FIG. 1 printing machine.

Referring now to FIG. 2, there is shown the detailed structure of developer unit 28. As shown therein housing 38 has a chamber 60 for storing a supply of developer mix therein. Mounted for rotation within chamber 60 of housing 38 are four magnetic brush developer rollers 30, 32, 34 and 36, respectively, each positioned with their axis in parallel and disposed closely adjacent to belt 10. Magnetic brush developer roller 30 has an outer cylinder or tubular member 62 made of non-magnetizable material and extending almost the length of housing 36. Disposed within tubular member 52 is bar magnet 64. Preferably, the exterior circumferential surface of tubular member 62 is roughened. Tubular member 62 is rotated by a motor (not shown) in the directon of arrow 66. As shown in FIG. 2, tubular member 62 is spaced a distance $d_1$ from belt 10. Magnetic brush developer roller 32 includes a tubular member 68 having a roughened exterior circumferential surface. Bar magnet 70 is disposed within tubular member 68. Tubular member 68 rotates in the direction of arrow 72 and is driven thereby by an external motor (not shown). Tubular member 68 is spaced a distance $d_2$ from belt 10. The distance $d_2$ is less than the distance $d_1$. Moreover, the angular velocity of tubular member 68 is greater than the angular velocity of tubular member 62. However, the diameter of tubular member 68 is substantially the same as the diameter of tubular member 62. Thus, the tangential velocity of tubular member 68 is greater than the tangential velocity of tubular member 62. However, the product of the tangential velocity of tubular member 62 and the distance $d_1$ is equal to the product of the tangential velocity of tubular member 68 and the distance $d_2$. Similarly, magnetic brush developer roller 34 includes a non-magnetic tubular member 74 having the exterior circumferential surface thereof roughened. A bar magnet 76 is disposed within tubular member 74. An external motor rotates tubular member 74 in the direction of arrow 78. Tubular member 74 is spaced the distance $d_2$ from belt 10. Moreover, the diameter of tubular member 74 is equal to the diameters of tubular members 68 and 62. Similarly, the angular velocity of tubular member 74 is equal to the angular velocity of tubular member 68. Thus, the tangential velocity of tubular member 74 is equal to the tangential velocity of tubular member 68. Finally, magnetic brush developer roller 36 includes a tubular member 80 having the exterior circumferential surface thereof roughened. An external motor (not shown) drives tubular member 80 in the direction of arrow 82. The angular velocity of tubular member 80 is equal to the angular velocity of tubular member 62. Moreover, the diameter of tubular member 80 is equal to the diameters of tubular members 62, 68 and 74. The spacing between tubular member 80 and belt 10 is also equal to $d_1$. Thus, the tangential velocity of tubular member 80 is equal to the tangential velocity of tubular member 62. Furthermore, the product of the tangential velocity of tubular member 80 and the distance $d_1$ is equal to the product of the tangential velocity of tubular member 74 and the distance $d_2$. Bar magnet 84 is disposed within tubular member 80.

By way of example, tubular members 62, 68, 74 and 80 are made preferably from aluminum. During a development cycle, tubular members 62, 68, 74 and 80 rotate in unison with one another with the respective bar magnets 64, 70, 76, and 84 being held substantially stationary. Tubular members 80, 74, 68, and 62 are contiguous with one another. The magnetic field generated by the respective bar magnets cause the developer mix to be attracted to the upper surfaces of the corrsponding tubular members. As the tubular members rotate, the developer mix advances across the upper surfaces thereof. In this manner, the bristle of developer mix extend in an outwardly direction from each tubular member and contact the electrostatic latent image recorded on the photoconductive surface of belt 10. After passing magnetic brush developer roller 36, the remaining developer mix and denuded carrier granules return to chamber 60 of housing 38. Thus, it is seen that the developer mix flow rate remains constant. Magnetic brush developer roller 30 and magnetic brush developer roller 36 travel more slowly than magnetic brush developer rollers 32 and 34. Magnetic brush developer roller 36 (the last roller in the developer unit), travels more slowly than the middle developer roller to facilitate pick-off of residual developer mix and denuded carrier granules. In order to prevent developer mix starvation in the middle developer rollers 32 and 34, respectively, magnetic brush developer roller 30 is spaced a greater distance from belt 10 than magnetic brush developer rollers 32 and 34. It should be noted that the increased inertia forces acting on the developer mix as it travels at high speed across developer rollers 32 and 34 cause tumbling and other agitation which enhances development of the electrostatic latent image without increasing background. By way of example, tubular members 62 and 80 may have a tangential velocity of 20 inches per second with the spacing $d_1$ being about 0.120 inches. Tubular members 68 and 74 have tangential velocity of about 60 inches per second with the spacing $d_2$ being about 0.040 inches. The product of the tangential velocity and spacing is constant for all the developer rollers being 2.4 inches$^2$ per second. For these parameters, belt 10 advances in the direction of arrow 12 at a speed of from 20 to 40 inches per second. Furthermore, the tangential velocity of each developer at the point closest to belt 10 is in the same direction as the velocity of belt 10.

This system has numerous advantages. By way of example, the developer mix is handled more gently at high speed. In addition, there is gentler contact of the developer mix with belt 10 at the entrance and exit zones thereof. Moreover, the mass flow rate is greater than is otherwise possible because of frictional forces on the respective tubular members.

In recapitulation, it is evident that the development apparatus of the present invention includes at least two magnetic brush developer rollers. The spacing between the photoconductive belt and one of the magnetic brush developer rollers is greater than the spacing between the photoconductive belt and the other one of the magnetic brush developer rollers. However, the tangential velocity of each of the magnetic brush developer rollers is inversely proportional to the spacing from the photoconductive belt. In this way, the product of the spacing between the magnetic brush developer roller and the photoconductive belt and the magnetic brush developer roller tangential velocity is equal for each magnetic brush developer roller. Hence, a blanket of developer mix is continually brought into contact with the electrostatic latent image recorded on a photoconductive surface. The movement of the electrostatic latent image is at a high speed and the development thereof is at a correspondingly high speed. This insures that a multiplicity of copies may be obtained from the electrophotograhic printing machine rapidly with all copies having substantially optimum quality.

It is, therefore, evident that there has been provided, in accordance wih the present invention, a development apparatus that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. An apparatus for depositing particles on a member, including:

first means, moving at a first velocity and spaced a first distance from the member, for depositing particles on the member, said first means comprises a first magnetic brush developer roller rotating at the first velocity and spaced the first distance from the member; and second means, moving at a second velocity and spaced a second distance from the member, for depositing particles on the member with the first velocity being less than the second velocity and the first distance being greater than the second distance, wherein the product of the first velocity and the first distance is substantially equal to the product of the second velocity and the second distance.

2. An apparatus as recited on claim 1, wherein said second means includes a second magnetic brush developer roller contiguous with said first magnetic brush developer roller, said second magnetic brush developer rotating at the second tangential velocity and spaced the second distance from the member.

3. An apparatus as recited in claim 2, wherein said first means includes a third magnetic brush developer roller rotating at the first tangential velocity and spaced the first distance from the member, said second magnetic brush developer roller being interposed between said first magnetic brush developer roller and said third magnetic brush developer roller and being contiguous therewith.

4. An apparatus as recited in claim 3, wherein said second means includes a fourth magnetic brush developer roller rotating at the second tangential velocity and spaced the second distance from the member, said fourth magnetic brush developer roller being interposed between said second magnetic brush developer roller and said third magnetic brush developer roller and being contiguous therewith.

5. An apparatus as recited in claim 4, wherein:

said first magnetic brush developer roller includes a first tubular member of non-magnetic material, and first magnetic means disposed fixedly within the first tubular member for creating a magnetic field in the path of the periphery of the first tubular member;

said second magnetic brush developer roller includes a second tubular member of non-magnetic material and second magnetic means disposed fixedly within the second tubular member for creating a magnetic field in the path of the periphery of the second tubular member;

said third magnetic brush developer roller includes a third tubular member of non-magnetic material, and third magnetic means disposed fixedly within the third tubular member for creating a magnetic field in the path of the periphery of the third tubular member; and said fourth magnetic brush developer roller includes a fourth tubular member of non-magnetic material, and fourth magnetic means disposed fixedly within the fourth tubular member for creating a magnetic field in the path of the periphery of the fourth tubular member.

6. An electrophotographic printing machine, including:

a photoconductive member;

means for charging at least a portion of said photoconductive member to a substantially uniform level;

means for projecting a light image of an original document being reproduced onto the charged portion of said photoconductive member dissipating selectively the charge to record thereon an electrostatic latent image; and means for advancing a developer mix of carrier granules and toner particles into contact with the electrostatic latent image so that the toner particles are attracted from the carrier granules to the latent image, said advancing means comprising first means, moving at a first velocity and spaced a first distance from said photoconductive member, for disposing the developer mix into contact with the latent image recorded on said photoconductive member, and second means, moving at a second velocity and spaced a second distance from said photoconductive member, for advancing the developer mix into contact with the latent image recorded on said photoconductive member with the first velocity being less than the second velocity and the first distance being greater than the second distance.

7. A printing machine as recited in claim 6, wherein the product of the first velocity and the first distance is substantially equal to the product of the second velocity and the second distance.

8. A printing machine as recited in claim 7, wherein the first means of said advancing means includes a first magnetic brush developer roller rotating at the first tangential velocity and spaced the first distance from said photoconductive member.

9. A printing machine as recited in claim 8, wherein the second means of said advancing means includes a second magnetic brush developer roller contiguous with the first magnetic brush developer roller, the second magnetic brush developer roller rotating at the second tangential velocity and spaced the second distance from the member.

10. A printing machine as recited in claim 9, wherein the first means of said advancing means includes a third magnetic brush developer roller rotating at the first tangential velocity and spaced the first distance from said photoconductive member, the second magnetic brush developer roller being interposed between the first magnetic brush developer roller and the second magnetic brush developer roller and being contiguous therewith.

11. A printing machine as recited in claim 10, wherein the second means of said advancing means includes a fourth magnetic brush developer roller rotating at the second tangential velocity and spaced the second distance from said photoconductive member, said fourth magnetic brush developer roller being interposed between the second magnetic brush developer roller and the third magnetic brush developer roller and being contiguous therewith.

12. A printing machine as recited in claim 11, wherein:

the first magnetic brush developer roller of said advancing means includes a first tubular member of non-magnetic material, and first magnetic means disposed fixedly within the first tubular member for creating a magnetic field in the path of the periphery of the first tubular member;

the second magnetic brush developer roller of said advancing means includes a second tubular member of non-magnetic material, and second magnetic means disposed fixedly within the second tubular member for creating a magnetic field in the path of the periphery of the second tubular member;

the third magnetic brush developer roller of said advancing means includes a third tubular member of non-magnetic material, and third magnetic means disposed fixedly within the third tubular member for creating a magnetic field in the path of the periphery of the third tubular member; and the fourth magnetic brush developer roller of said advancing means includes a fourth tubular member of non-magnetic material, and fourth magnetic means disposed fixedly within the fourth tubular member for creating a magnetic field in the path of the periphery of the fourth tubular member.

13. A printing machine as recited in claim 6, further including:

means for transferring the toner particles from the latent image recorded on said photoconductive member to a sheet of support material; and means for fixing substantially permanently the toner particles to the sheet of support material forming a copy of the original document.

* * * * *